US007134828B2

(12) United States Patent
Knez

(10) Patent No.: US 7,134,828 B2
(45) Date of Patent: Nov. 14, 2006

(54) APPARATUS FOR RETRIEVING GOLF BALLS

(75) Inventor: Jordan Knez, Halmstad (SE)

(73) Assignee: Range Servant AB, Halmstad (SE)

( * ) Notice: Subject to any disclaimer, the term of this patent is extended or adjusted under 35 U.S.C. 154(b) by 17 days.

(21) Appl. No.: 10/501,216

(22) PCT Filed: Jan. 15, 2003

(86) PCT No.: PCT/SE03/00051

§ 371 (c)(1),
(2), (4) Date: Jul. 12, 2004

(87) PCT Pub. No.: WO03/059464

PCT Pub. Date: Jul. 24, 2003

(65) Prior Publication Data

US 2005/0079035 A1 Apr. 14, 2005

(30) Foreign Application Priority Data

Jan. 16, 2002 (SE) ..... 0200128

(51) Int. Cl.
*B60P 1/00* (2006.01)

(52) U.S. Cl. ..... 414/436; 414/440

(58) Field of Classification Search ..... 414/436, 414/440

See application file for complete search history.

(56) References Cited

U.S. PATENT DOCUMENTS

| | | | | | |
|---|---|---|---|---|---|
| 2,365,540 | A | | 12/1944 | Fonken | 214/65 |
| 2,735,562 | A | * | 2/1956 | Kazanjian | 414/434 |
| 3,175,714 | A | | 3/1965 | Wittek | 214/356 |
| 3,362,551 | A | | 1/1968 | Shoemaker | 214/356 |
| 3,813,859 | A | * | 6/1974 | Fuller et al. | 56/260 |
| 3,995,759 | A | | 12/1976 | Hollrock et al. | 214/356 |
| 5,135,345 | A | * | 8/1992 | Kazanjian | 414/442 |
| 5,141,383 | A | | 8/1992 | Phillips et al. | 414/440 |
| 5,149,245 | A | * | 9/1992 | Landmann | 414/440 |
| 6,082,955 | A | * | 7/2000 | Tucek | 414/440 |

FOREIGN PATENT DOCUMENTS

WO WO 88/06910 A1 9/1988

* cited by examiner

*Primary Examiner*—Thomas J. Brahan
(74) *Attorney, Agent, or Firm*—McGinn IP Law Group, PLLC

(57) ABSTRACT

An apparatus for retrieving golf balls and the like includes a number of retrieving sections, each having a frame for one or more receptacle baskets and a retrieving roller with a number of retrieving disks. The frames are connected to a connection rail in side-by-side relationship. The connection rail is readily flexible over its entire length in the vertical plane and is rigid or substantially inflexible in the horizontal plane.

15 Claims, 2 Drawing Sheets

1
2
3
4
5
13
14
15
18
23
24
25
26

A 1:5
A
I
II

APPARATUS FOR RETRIEVING GOLF BALLS

FIELD OF THE INVENTION

The present invention relates to an apparatus for retrieving golf balls and the like.

BACKGROUND

The growing expansion of the game of golf places ever higher demands on the auxiliary aids which are required for the rational operation of, above all, practice courses. These practice courses are moreover utilised to an ever increasing degree because of the fact that reasonable levels of golf playing skill on the golf courses themselves require constant practice, to which few have access other than at specifically designed practice courses, so-called driving ranges. Among other things, efficient golf ball retrievers are needed which display high operational reliability and simple construction. The simpler the construction, the higher the operational reliability. In many cases, a simple design and construction also entail a considerable reduction in costs. Prior art apparatuses suffer from relatively complicated design, which entails frequent operational stoppages, and such apparatuses are relatively inefficient in that they often fail to retrieve golf balls because of unevenness in the terrain. For this reason, a large number of golf balls will generally be left out on the course, and in all likelihood many of these remaining golf balls will be pressed down into the ground and can, as a result, not be retrieved by machine but will, in all probability be lost. Golf balls which remain out on the course may also be damaged by lawn mowers and other equipment and may, moreover, entail damage to the lawn mower and the equipment themselves, which may result in considerable repair costs.

SUMMARY OF THE INVENTION

The task forming the basis of the present invention is to realise a golf ball retriever which satisfies the above-mentioned needs and desires, without any deterioration in the retrieving efficiency of the apparatus.

The present invention realises a golf ball retriever displaying an extremely simple and reliable construction, which ensures a high level of operational reliability, without any reduction in the desired retrieving efficiency. Thanks to the vertical flexing capability in the connection rail, the different retrieving sections will follow the contour of the ground in an extremely exact and satisfactory manner. Thanks to the horizontal rigidity or inflexibility of the connection rail, the retrieving sections will be steered in an extremely efficient manner, whereby specific coupling devices between the retrieving sections can be omitted.

BRIEF DESCRIPTION OF THE DRAWINGS

The present invention will now be described in greater detail hereinbelow, with particular reference to the accompanying drawings.

DETAILED DESCRIPTION OF PREFERRED EMBODIMENTS

Figures 1, 2:
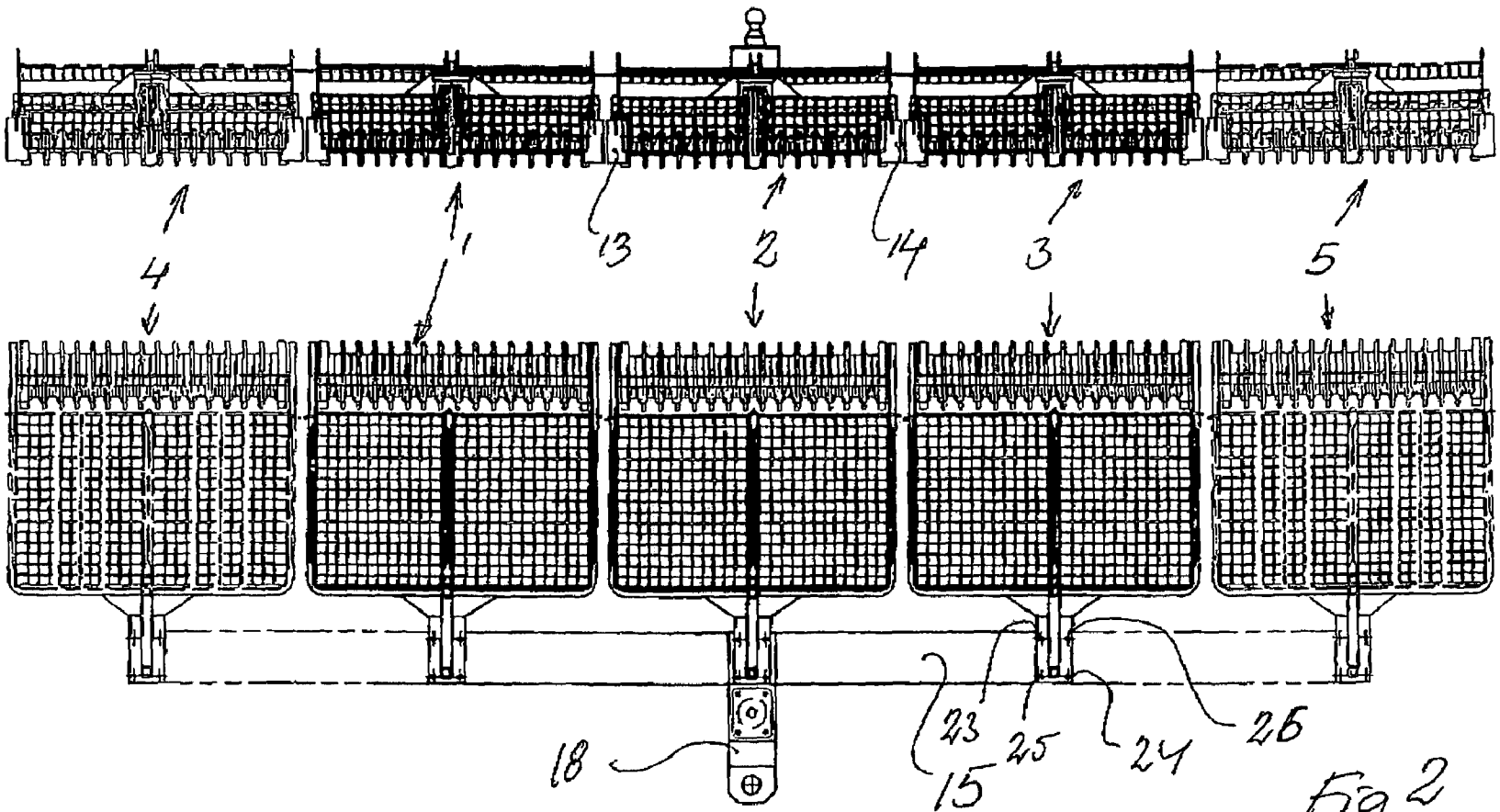
FIG. 1 is a front elevation of an apparatus according to the present invention.
FIG. 2 is a top plan view of the apparatus according to FIG. 1.

The apparatus shown on the drawings according to one embodiment of the present invention has three retrieving sections 1, 2 and 3 shown by solid lines, as well as two retrieving sections 4 and 5 shown by broken lines. There is nothing to prevent additional retrieving sections of the same type as the sections 4 and 5 from being connected up with the sections 1 to 5 to form a golf ball retriever with seven or more retrieving sections. Further, it is possible to couple together only two retrieving sections to form a small, simple golf ball retriever, which may possibly be drawn by hand.

The different retrieving sections 1 to 5 have a frame 6 which extends between a mounting plate 7 and a retrieving roller 8. The retrieving roller 8 consists of a number of retrieving disks 9 which are manufactured from plastic or rubber and which are mounted on one or more rollers, for example a tube of suitable diameter.

The frames 6 of the retrieving sections 1–5 are intended for a number of wire baskets 10 for collecting the golf balls. Ahead of the retrieving roller 8, there is disposed an ejector 11 which has fingers which extend in between the retrieving disks 9 for ejecting golf balls that have fastened between the disks 9 so that the balls arrive in the wire baskets 10. The wire baskets 10 may be of a so-called self-emptying construction, or may quite simply be liftable up out of the frame 6 for emptying into a storage container for subsequent washing or discharge in an automatic ball dispenser. There are both upwardly directed and downwardly directed fingers 12. At the side edges, the retrieving sections 1–5 have guide plates 13 and 14 for guiding golf balls towards the retrieving rollers B.

The retrieving sections 1–5 are mounted on a connection rail 15 by the intermediary of the mounting plate 7. As will be apparent from FIG. 4, the connection rail 15 may consist of a number of sections 15*a* and 15*b* which are screwed together to one another, together with the mounting plate 7, and are mounted on a wheel 16 which advantageously is a swivel wheel. Ahead of the wheel 16, there is disposed a guide plate 17 for guiding possible golf balls away from the wheel 16 so that they are not run over by the wheel. The wheels 16 and the retrieving disks 9 have diameters such that wheels 16 support the retrieving sections 1–5 with the plurality of retrieving disks 9 adjacent the ground to lift golf balls from the ground and eject the lifted golf balls into the receptacle baskets 10 as the apparatus moves over the ground. The connection rail 15 shown in FIG. 4 consists of three or four sections which are interconnected, in accordance with FIG. 4, at each mounting plate 7. It is naturally also conceivable that the central section ahead of the centremost retrieving section 2 is of one piece manufacture, while the outer sections of the retrieving sections 4 and 5 are in shorter pieces and are interconnected with the central connection rail at the mounting plates 7 for the sections 1 and 3.

A drawbar 18 is mounted on the connection rail 15 and the mounting plate 7 for the section 2 and carries a wheel 19 of the same type as the wheel 16. Ahead of the wheel 19, there is also disposed a guide plate 20 of the same type as the guide plate 17 ahead of the wheel 16. The drawbar 18 further supports a hitch ball 21. Naturally, this may be replaced by a draw lug, a draw hook or some other type of drawing device for interconnection with a corresponding device on a vehicle of the traction or shunting type.

It is appropriate to provide a wheel 16 for each mounting plate 7 apart from that mounting plate 7 which is screwed together with the drawbar 18 and the connection plate 15 which belongs to the frame 6 of the retrieving section 2. If the connection rail 15 is extremely soft and easily flexible in the vertical direction, it is not only appropriate but also necessary to provide a wheel 16 for each of the above-mentioned mounting plates 7. This is naturally particularly important in large retrievers with as many retrieving sections 1–5 as five, seven or more.

The connection rail 15 is advantageously manufactured from a resilient material, e.g. duraluminium or spring steel depending on the desired properties. In addition, the connection rail should have a width-thickness ratio of approximately 150:5, when it is manufactured from duraluminium. But other width-thickness ratios are also naturally conceivable, depending on the choice of material and the desired properties. In the application of a larger width-thickness ratio of, for example, 200:2, it may be appropriate to employ a stainless spring steel material. The vital factor is that the connection rail has a great capability to flex and bend in the vertical direction, i.e. in the vertical plane, while at the same time displaying a high degree of rigidity or quite simply being substantially inflexible in the horizontal direction, i.e. in the horizontal plane. The length of the connection rail 15 is defined as the dimension of the connection rail 15 transversely of the retrieving sections 4 or the extent which is required for interconnecting the retrieving sections 4 in side-by-side relationship. This dimension is also considered as the longitudinal axis of the connection rail 15 and lies in the horizontal plane, while the thickness of the connection rail 15 is its dimension in the vertical plane and the width of the connection rail 15 is its dimension in the horizontal plane at right angles to the longitudinal axis of the connection rail 15.

Figures 3, 4:
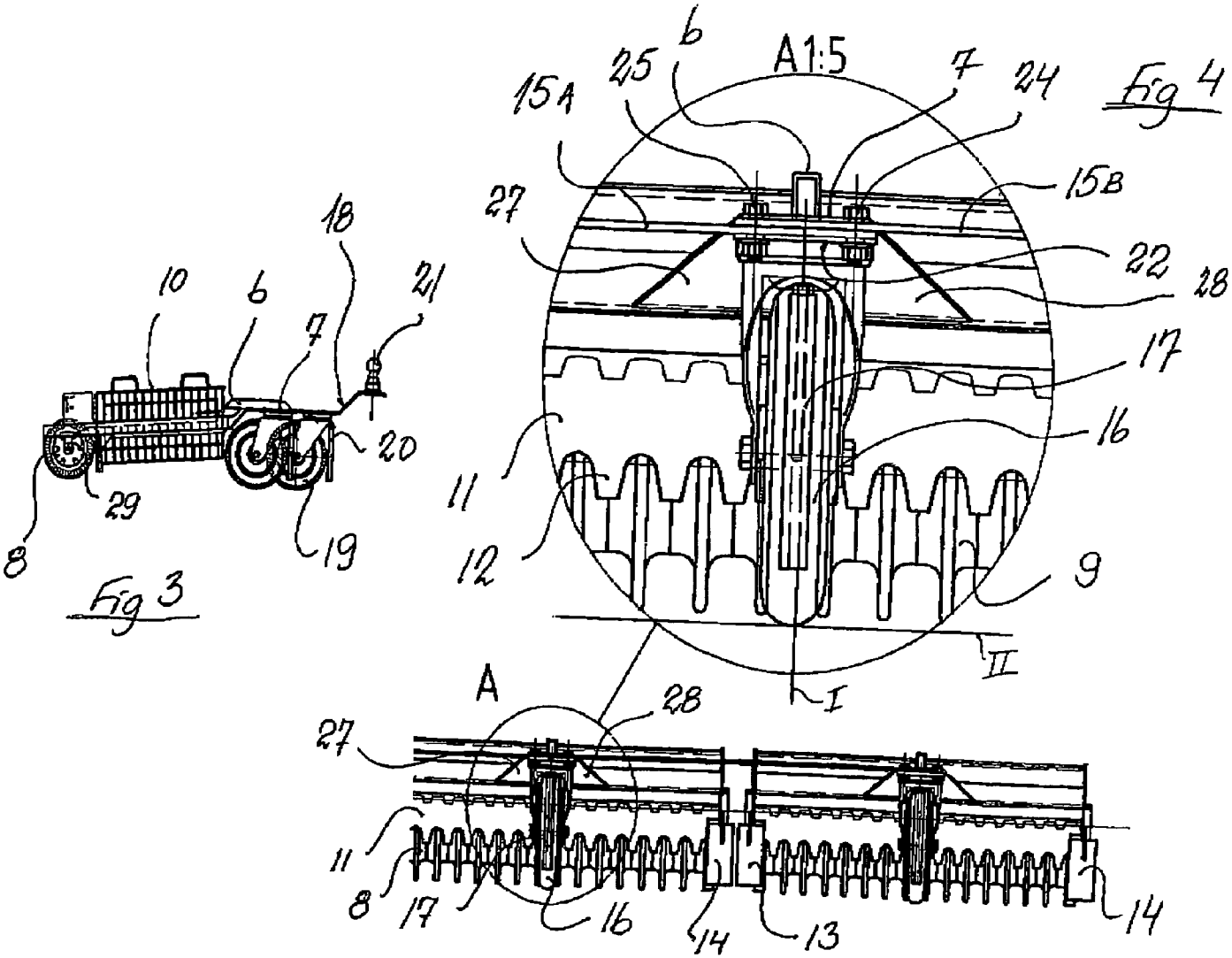
FIG. 3 is a side elevation of the apparatus according to FIGS. 1 and 2.
FIG. 4 shows, on a larger scale, the encircled area A of the apparatus according to FIG. 1.

It will further be apparent from FIG. 4 that the mounting plate 7 from the frame 6 is mounted on the connection rail section 15*b*, which in its turn is mounted on the connection rail section 15*a* and thereafter on a wheel mounting plate 22 with the aid of bolts 23 and 24, as well as 25 and 26 which extend through mutually aligned holes in the mounting plate 7, the sections 15*a* and 15*b*, and also the wheel mounting plate 22.

The frame 6 is rigidly connected to the mounting plate 7, this rigid connection optimally being a weld. Reinforcement plates 27, 28 are fixedly welded between the mounting plate 7 and the frame 6. The frame 6 extends ahead of the basket or baskets 10 and has shanks on either side of the basket or baskets. The frame shanks extend up to and slightly past the shaft of the retrieving roller 8 where they support brackets 29 for the shaft of the retrieving roller 8. Despite the rigid connection between the mounting plate 7 of the frame 6 and the connection rail 15, the ends of the retrieving roller 8 may move up and down as much as approximately 50–80 mm and even as much as 100 mm and more thanks to the capability of the connection rail 15 to be highly flexible in the vertical direction.

Many modifications are naturally conceivable without departing from the scope of the inventive concept.

The invention claimed is:

1. An apparatus for retrieving golf balls, said apparatus comprising:

a plurality of retrieving sections, each retrieving section including a frame, one or more receptacle baskets removably supported on the frame, and a retrieving roller having a plurality of retrieving disks;

a connection rail interconnecting the frames in side-by-side relationship; and a plurality of support wheels, separate from the retrieving disks, one support wheel being positioned at substantially the middle of the plurality of retrieving disks of each of at least some of the retrieving sections, wherein:

over its entire length the connection rail is readily flexible in the vertical plane and rigid or substantially inflexible in the horizontal plane, and the support wheels support the retrieving sections with the plurality of retrieving disks adjacent the ground to lift golf balls from the ground and erect the lifted golf balls into the receptacle baskets as the apparatus moves over the ground.

2. The apparatus as claimed in claim 1, wherein each of the frames includes a mounting plate for fixedly mounting the frames on the connection rail.

3. The apparatus as claimed in claim 2, wherein the connection rail comprises a plurality of sections interconnected with one another at one or more of the mounting plates.

4. The apparatus as claimed in claim 2, further comprising a drawbar mounted on the connection rail at the mounting plate of a centrally placed one of the frames.

5. The apparatus as claimed in claim 2, wherein the connection rail is formed of a resilient material.

6. The apparatus as claimed in claim 1, wherein the connection rail comprises a plurality of connection rail sections interconnected with one another at one or more of the frames.

7. The apparatus as claimed in claim 6, further comprising a drawbar mounted on the connection rail at a centrally placed one of the frames.

8. The apparatus as claimed in claim 6, wherein the connection rail is formed of a resilient material.

9. The apparatus as claimed in claim 1, further comprising a drawbar mounted on the connection rail at a centrally placed one of the frames.

10. The apparatus as claimed in claim 9, further comprising a wheel mounted on the drawbar; and a drawing device mounted on the drawbar.

11. The apparatus as claimed in claim 10, wherein the connection rail is formed of a resilient material.

12. The apparatus as claimed in claim 9, wherein the connection rail is formed of a resilient material.

13. The apparatus as claimed in claim 1, wherein the connection rail is formed of a resilient material.

14. The apparatus as claimed in claim 13, wherein the connection rail has a width to thickness ratio of 100 to 1.

15. The apparatus as claimed in claim 13, wherein the connection rail has a width to thickness ratio of 30 to 1.

* * * * *